US008488418B2

(12) United States Patent
Blanckaert et al.

(10) Patent No.: US 8,488,418 B2
(45) Date of Patent: Jul. 16, 2013

(54) TIMEPIECE WITH SPECIAL AESTHETIC EFFECTS

(75) Inventors: Nicolas Blanckaert, Boudry (CH); Francois Klopfenstein, Delemont (CH); Andre Kaltenrieder, Preles (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 48 days.

(21) Appl. No.: 13/376,232

(22) PCT Filed: Jun. 18, 2010

(86) PCT No.: PCT/EP2010/058650

§ 371 (c)(1), (2), (4) Date: Dec. 5, 2011

(87) PCT Pub. No.: WO2010/146162

PCT Pub. Date: Dec. 23, 2010

(65) Prior Publication Data

US 2012/0082012 A1 Apr. 5, 2012

(30) Foreign Application Priority Data

Jun. 18, 2009 (EP) ..... 09163086
Oct. 9, 2009 (EP) ..... 09172673

(51) Int. Cl.
*G04B 19/00* (2006.01)

(52) U.S. Cl.
USPC ..... 368/224

(58) Field of Classification Search
USPC ..... 368/223–237, 67, 88, 294, 296, 68; 116/286–289; 362/23, 26, 29, 30
See application file for complete search history.

(56) References Cited

U.S. PATENT DOCUMENTS

| | | | | |
|---|---|---|---|---|
| 4,247,928 | A | 1/1981 | Dorfman | |
| 5,604,716 | A | 2/1997 | Cheung | |
| 5,734,627 | A * | 3/1998 | Sy | 368/67 |
| 5,838,644 | A * | 11/1998 | Yoneda et al. | 368/232 |
| 6,052,338 | A | 4/2000 | Shevins | |
| 6,208,591 | B1 | 3/2001 | Sakurazawa et al. | |
| 6,452,872 | B1 | 9/2002 | Teijido et al. | |
| 6,690,623 | B1 | 2/2004 | Maano | |
| 7,839,726 | B2 * | 11/2010 | Winkler | 368/67 |

(Continued)

FOREIGN PATENT DOCUMENTS

| | | |
|---|---|---|
| EP | 1 666 992 | 6/2006 |
| GB | 2 294 589 | 5/1996 |
| JP | 07294668 | 11/1995 |

OTHER PUBLICATIONS

International Search Report Issued Sep. 3, 2010 in PCT/EP10/058650 Filed Jun. 18, 2010.

*Primary Examiner* — Edwin A. Leon
(74) *Attorney, Agent, or Firm* — Oblon, Spivak, McClelland, Maier & Neustadt, L.L.P.

(57) ABSTRACT

A timepiece which, in addition to a crystal, includes the following external elements: a back cover, a middle part, a dial, a bezel, and two wristband strands. At least one of these external elements is at least partially transparent or translucent. The back cover, the middle part, and the bezel define an internal volume of the watch case that houses a timepiece movement. At least one light source is housed within the internal volume and produces a light that passes through the transparent or translucent part of the external element.

20 Claims, 8 Drawing Sheets

U.S. PATENT DOCUMENTS

| | | | | |
|---|---|---|---|---|
| 8,169,858 | B2 * | 5/2012 | Klopfenstein et al. | 368/67 |
| 2003/0227828 | A1 | 12/2003 | Arroyo | |
| 2005/0213343 | A1 | 9/2005 | Jablonski | |
| 2008/0004510 | A1 | 1/2008 | Tanzawa et al. | |
| 2009/0109650 | A1 | 4/2009 | Winkler | |
| 2009/0109651 | A1 | 4/2009 | Winkler | |
| 2009/0109801 | A1 | 4/2009 | Winkler | |

* cited by examiner

TIMEPIECE WITH SPECIAL AESTHETIC EFFECTS

The present invention concerns a timepiece with special aesthetic effects. More specifically, the present invention concerns a timepiece having original light effects.

Creating timepieces such as wristwatches with an improved aesthetic appearance is an ever present concern for timepiece manufacturers and particularly for the persons responsible for designing the various external timepiece elements. It would take too long to draw up a list here of all the solutions which have been envisaged to providing timepieces with the most stylish and attractive appearance possible. The following may be cited, purely by way of example: the technique of engine turning dials, the shape and/or colour of appliques on the dial or also the addition of precious or semi-precious stones.

The present invention forms part of the search to offer clients watches whose appearance is both attractive and unexpected.

Owing to these features, the present invention provides a timepiece which, compared to the prior art, further includes, on the side of a crystal, a digital display, underneath which there is arranged a light guide, into which is injected the light produced by a light source for back lighting the digital display, the light which escapes through the sides of the light guide which are opposite the middle and the back cover of the watch case passing through the transparent or translucent part of the external element concerned.

An objective technical problem solved by these distinctive features can be seen in the fact that advantage is taken of the light which escapes from the light guide in order to light the transparent or at least translucent parts of the watch case.

The result obtained is thus twofold: the back lighting of a digital display device, such as a liquid crystal cell, in order to improve the readability thereof, and improvement in the attractiveness of the watch by using the light that escapes from the light guide to light the transparent or translucent external watch elements.

This solution is not, to the Applicant's knowledge, either disclosed or even suggested in any state of the art documents, since it is undeniably contrary to the technical prejudices of those skilled in the art.

Indeed, for the case in which a light guide is used in a watch for back lighting a digital display device, those skilled in the art seek at all costs to avoid any light leakage in order to have the highest possible lighting density in the display device which ensures the best possible luminosity for the display device.

Conversely, the present invention has chosen to compromise. It is accepted that light leaks from the light guide, which may lead to somewhat diminished lighting by the light device, but which nonetheless remains within acceptable limits, and advantage is taken of this light leakage to light the transparent parts of the watch case, thereby providing an attractive effect for the watch.

The aesthetic appearance of the watch may be practically infinitely varied.

Since the light source is housed in the internal volume of the watch case, it is, for example, possible to envisage a middle part that is partially or totally transparent, so that the light produced by the light source is diffused through said middle part. Likewise, it may be envisaged to illuminate the appliques on the watch dial. The dial may therefore by totally opaque and only allow light to escape where the appliques are located. It is also possible to envisage covering a transparent dial with an opaque mask which also only allows light to escape where the appliques are located.

Various ways of allowing the light to escape may be envisaged. According to a simplified embodiment of the invention, the light produced by the light source directly lights the transparent or translucent areas of the external element or elements which the light is required to pass through. This embodiment is applicable when there is no obstacle inserted between the light source and the external element to be illuminated.

According to a second variant, the light source is a light emitting diode (LED), which emits ultraviolet, violet, blue, white or infra-red light and the external element is made of plastic material charged with fluorescent and/or phosphorescent particles. Consequently, the fluorescent and/or phosphorescent particles absorb the emitted radiation and re-emit a homogeneous visible light. According to the type of particles selected, whether they are fluorescent and/or phosphorescent, the luminous effect ceases as soon as the light source is turned off or conversely continues by the effect of remanence.

According to a third embodiment, the light produced by the light source is injected into a light guide, which then brings the light to the transparent or translucent area(s) of the external element(s) concerned. According to a variant, the light guide is an optical fibre which can move around any obstacles which may stand between the light source and the transparent or translucent area of the external element concerned through which the light will escape from the internal volume of the watch case. The optical fibre may be an optical fibre which diffuses the injected light over its entire length.

Preferably, the light source is a light emitting diode (LED) mounted on a printed circuit board (PCB) type support, together with the electronic control circuit thereof. The light source is powered, for example, by an interchangeable or rechargeable battery or by a solar cell.

At the places where the light must not pass, the external element concerned may be opaque in the mass or coated with a layer of opaque paint.

Other features and advantages of the present invention will appear more clearly from the following detailed description of various example embodiments of the invention, these examples being given solely by way of non-limiting illustration with reference to the annexed drawing, in which.

Figure 5A:
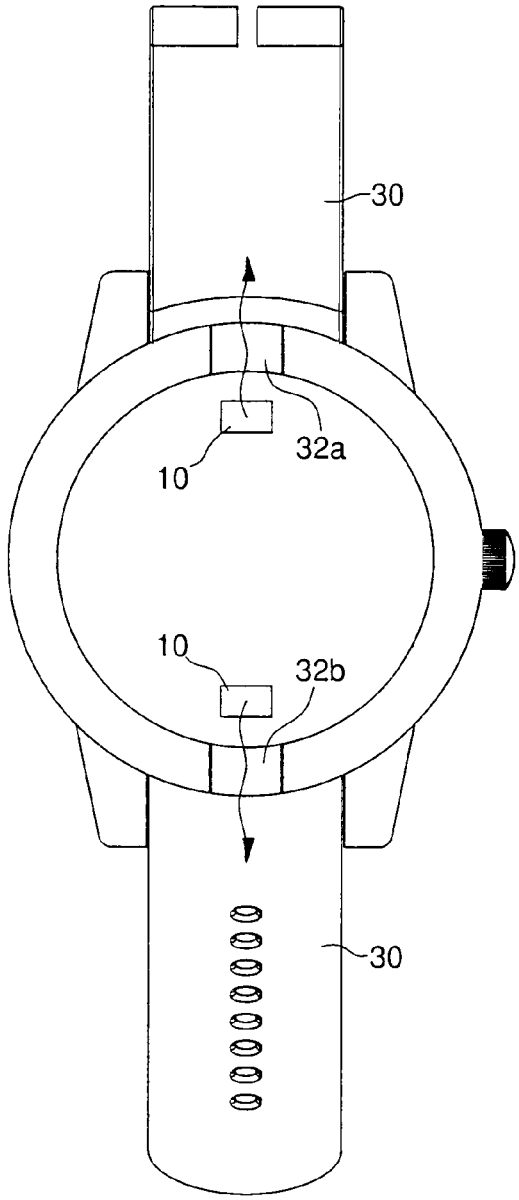

FIG. 5*a* is a top view of a wristwatch including two wristband strands into which the light is diffused.

Figure 5B:
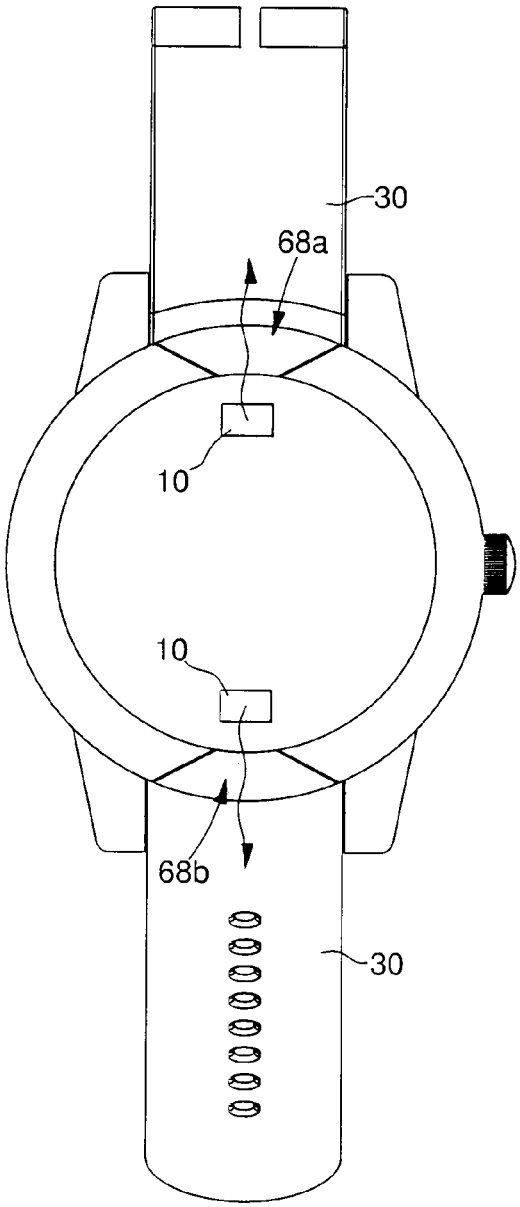

FIG. 5B is a similar view to that of FIG. 5A, wherein the transparent parts placed where the wristband strands are secured to the middle part are conical in shape.

Figure 5C:
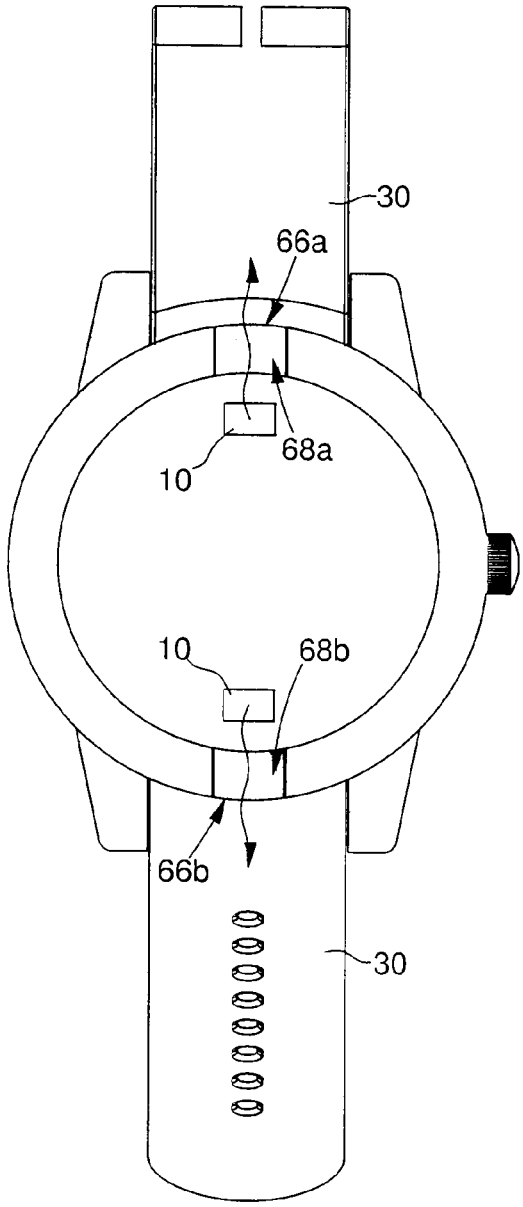

FIG. 5C is a similar view to that of FIG. 5A, wherein the transparent parts placed where the wristband strands are secured to the middle part are formed by two straight sections of an optical fibre bar.

Figure 6:
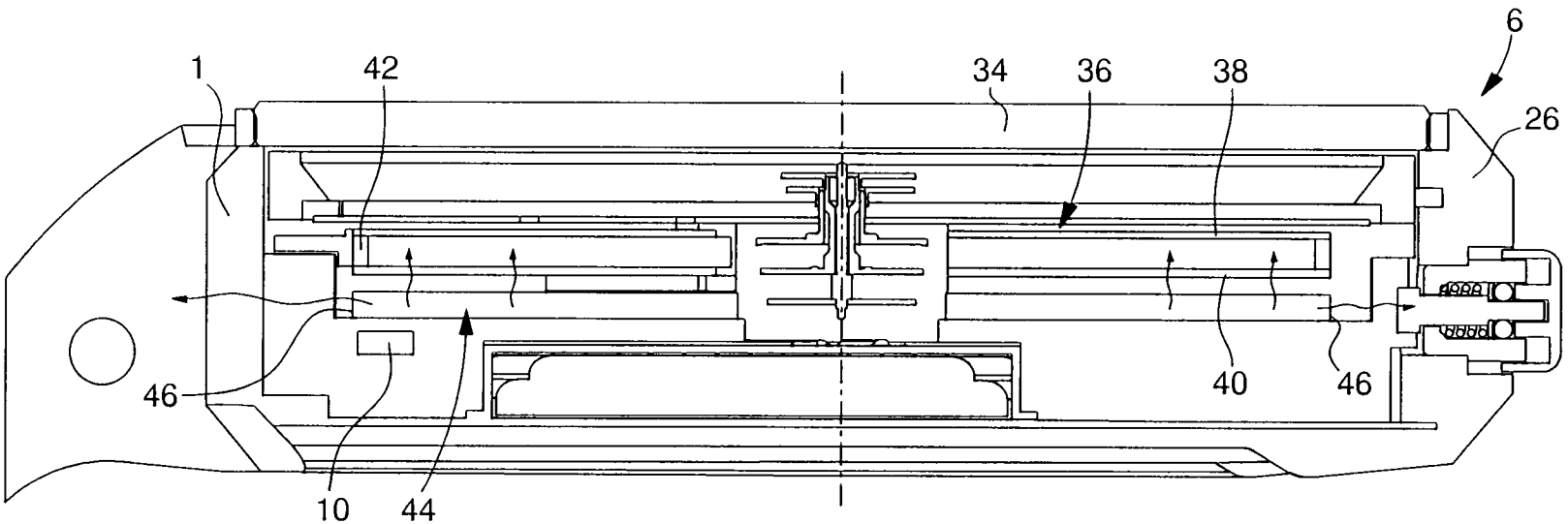

FIG. 6 is a cross-section of a watch case with a digital display.

Figure 7:
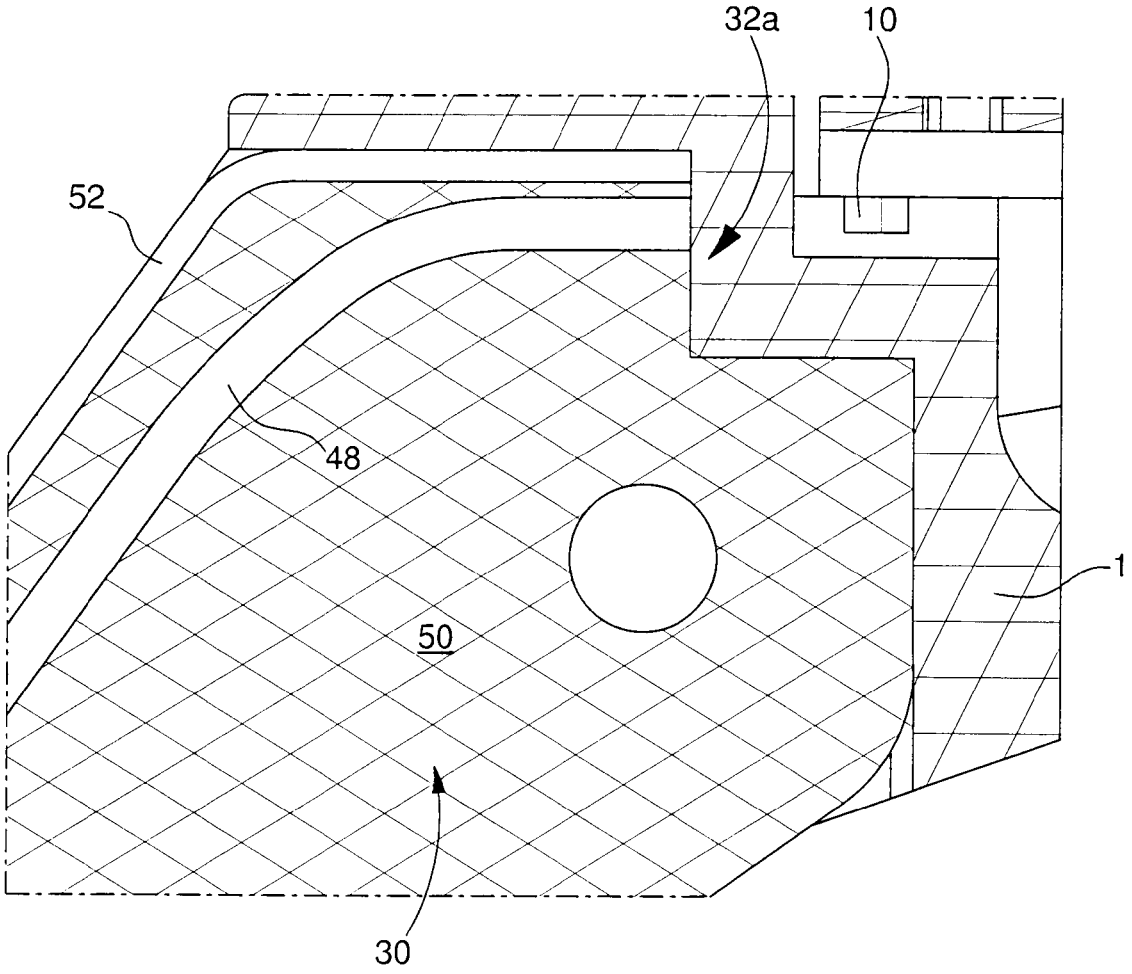

FIG. 7 is a longitudinal cross-sectional of a wristband strand including a light guide in which the light is diffused.

The present invention proceeds from the general inventive idea which consists in housing at least one light source in the internal volume of a watch case, wherein the light produced by the light source can escape towards the exterior of the watch case through at least one external element of the watch, which is at least partially transparent or at the very least translucent. A timepiece with original aesthetic effects is thus obtained having an extremely attractive appearance in the dark or darkness.

Figure 1:
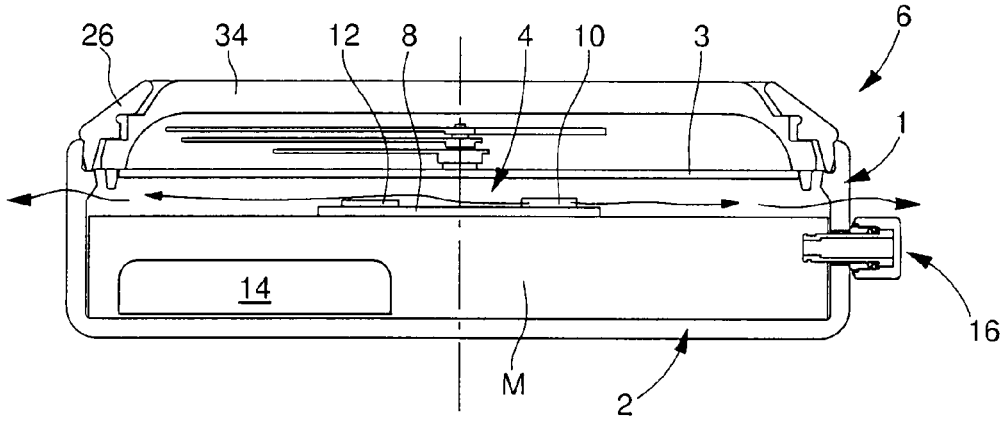
FIG. 1 is a cross-section of a watch case provided with a light source according to the invention.

FIG. 1 is a cross-section of a middle part 1 delimiting, with a back cover 2 and a dial 3, an internal volume 4 of a watch case 6. For the purposes of this description, it will be assumed that the watch is an electronic watch and that the movement M thereof is arranged in the back cover of watch case 6. Consequently, above movement M, a PCB type plate-support 8 can be arranged, with, for example, an LED light source 10, and its electronic control circuit mounted thereon. The light source 10 is powered for example by a rechargeable or interchangeable battery 14 conventionally arranged underneath timepiece movement M on the side of back cover 2 of watch case 6. It will be clear that the watch according to the invention may be electronic, electromechanical or even purely mechanical. In this latter case, it is sufficient to provide a housing for receiving a battery which will exclusively power light source 10 and its electronic control circuit 12. Thus, this invention may be applied to any type of wristwatch, the only constraint to be respected being that there is no obstacle to the propagation of light between the light source and the external element through which said light must pass.

Figure 2:
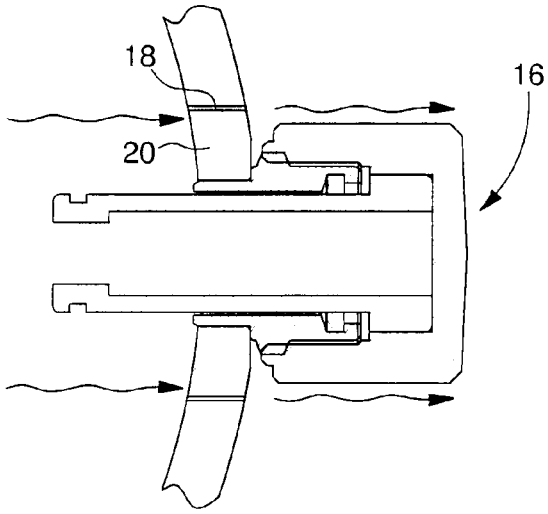
FIG. 2 is a partial cross-section of the middle part of a watch according to the invention.

According to one embodiment of the invention illustrated in FIG. 2, a crown of light is created around a control member of the watch such as a push-button 16. If the middle part 1 is metallic, a through hole 18 is made therein, in which there is engaged a transparent or at the very least translucent cylinder 20 which will act as a light guide for the light that escapes from watch case 6. It will be clear that, in order to obtain the desired effect, namely of forming a crown of light around the head of push-button 16, the external diameter of the transparent or translucent cylinder 20 must be greater than the external diameter of the head of push-button 16.

In addition to the function of light guide, cylinder 20 may also be used as a mechanical guide for push-button 16. Of course, it is also possible to introduce an insert into cylinder 20 which will act as a mechanical guide for push-button 16. If middle part 1 is made of a transparent or translucent material such as a plastic material, a ceramic material, sapphire or silica glass, it can be dyed in the mass except in an area surrounding push-button 16, where the material remains transparent or translucent. In order to simplify the method of injecting plastic middle part 1, the latter can also be dyed in the mass throughout, and then a through hole can be machined in which a transparent or translucent cylinder is engaged, as explained hereinbefore with reference to a metallic middle part. Yet another solution consists in making middle part 1 by injection a transparent plastic material, and then coating the internal face of the middle part with a layer of light absorbent material except in the area surrounding push-button 16. To vary the effects, in particular in proximity to push-button 16, it is also possible to overmould a transparent or translucent plastic material onto the external element considered made in an opaque material.

Any type of light source such as an incandescent lamp, light emitting diode, organic light emitting diode or other source may be used. In a particular embodiment of the invention, a light emitting diode emitting ultraviolet, violet, blue, white or infra-red light is used in combination with a middle part made of plastic material charged with fluorescent and/or phosphorescent particles. Consequently, the fluorescent and/or phosphorescent particles absorb the radiation emitted by the diode and re-emit a homogeneous visible light. According to the type of particles selected, whether they are fluorescent and/or phosphorescent, the luminous effect ceases as soon as the light source is turned off or conversely continues by the effect of remanence.

The external element or elements of the watch, which allow all or part of the light produced by the light source to pass, may be directly illuminated by the light source. These external elements may nonetheless also be illuminated indirectly by the light source. By way of example, FIG. 3 shows a middle part 1, made of plastic material, along the internal side of which there is fixed a light guide 22, which brings the light from the point where it was injected into guide 22 to the transparent or translucent areas of the external element(s) concerned, through which the light will escape from the internal volume 4 of watch case 6. According to a variant, the light guide 22 is an optical fibre or an optical fibre bundle which can move around any obstacles which may stand between the light source 10 and the transparent or translucent area of the external element concerned, through which the light will escape from the internal volume 4 of watch case 6. As illustrated in FIG. 3, the optical fibre may be an optical fibre which diffuses the injected light over its entire length. The light guide may also be a transparent plastic ring, for example of round or circular section.

According to a first variant (FIG. 3B) a V-shaped notch 54 is made in light guide 22 opposite light source 10. The angle formed by the two arms 54*a* and 54*b* of notch 54 is adjusted according to the light emission cone of light source 10, to ensure optimum efficiency of light injection into light guide 22, such as an optical fibre bundle.

Figure 3A:
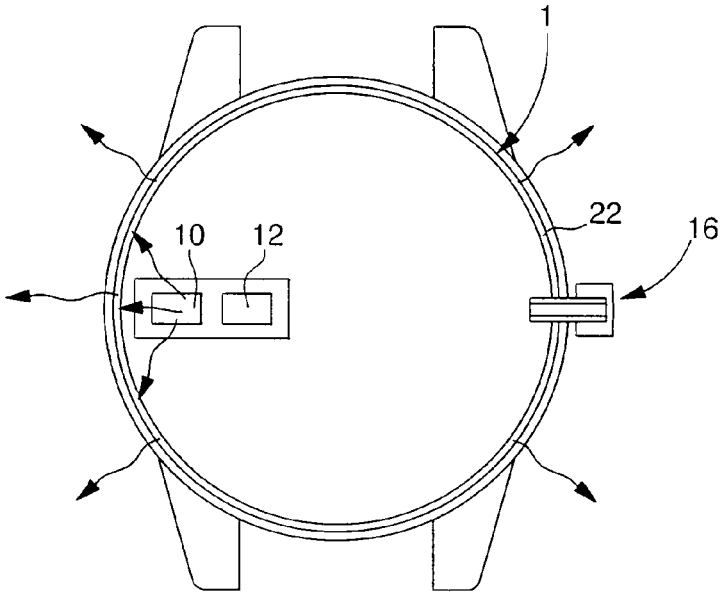
FIG. 3A is a top view of the middle part of a watch along the internal side of which there is fixed a diffusing optical fibre into which light is injected.
Figure 3B:
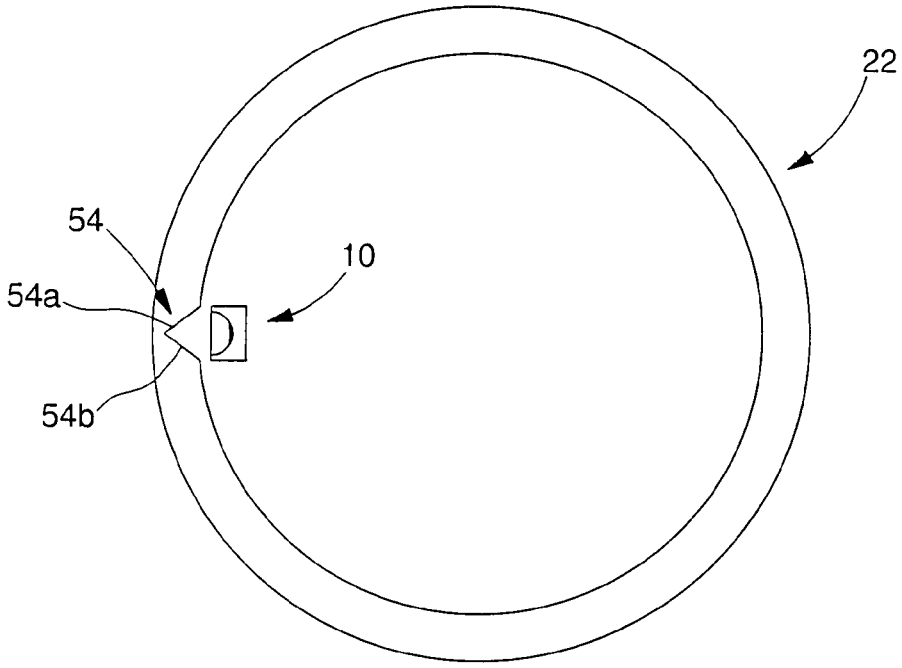
FIG. 3B illustrates an optical fibre bundle in which a V-shaped notch is made opposite the light source to optimise the efficiency of light injection into the optical fibres.
Figure 3C:
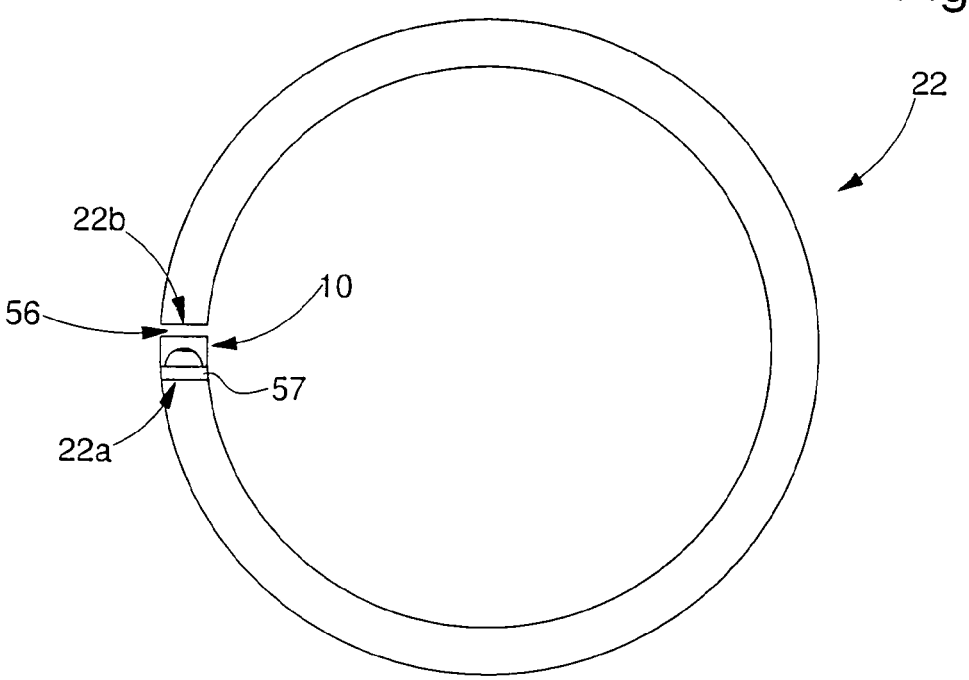
FIG. 3C illustrates an optical fibre bundle which is truncated at one place on the perimeter thereof for the insertion of a light source in the space left vacant.
Figure 3D:
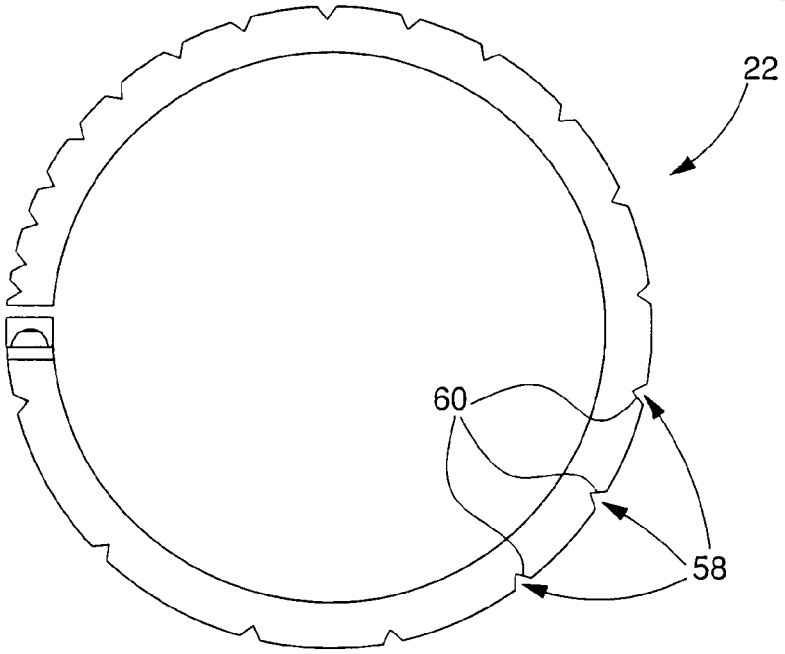
FIGS. 3D to 3F illustrate an optical fibre bundle provided with a plurality of optical extractors which respectively take the form of V-shaped grooves, micro-lenses or small printed surfaces. The density of these optical extractors increases the further they are from the light source.
Figure 3E:
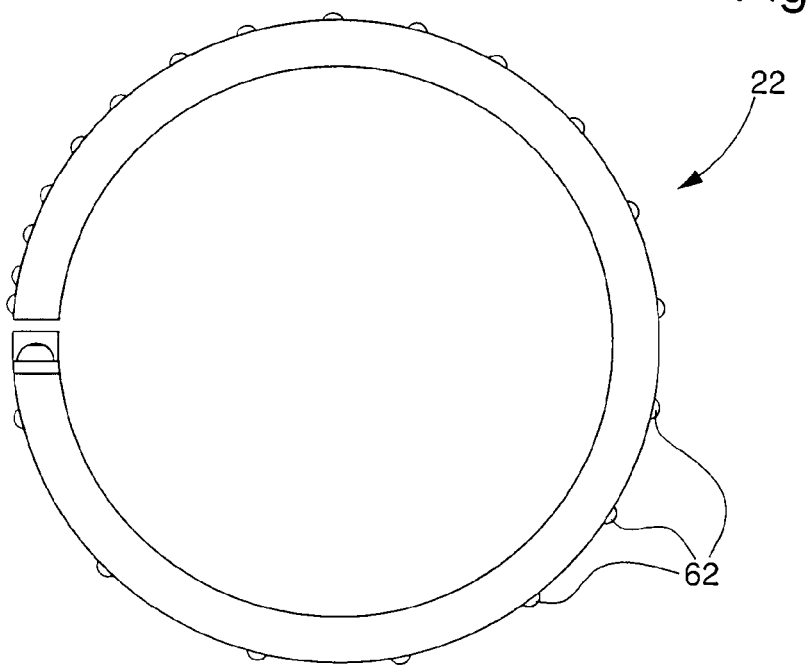
Figure 3F:
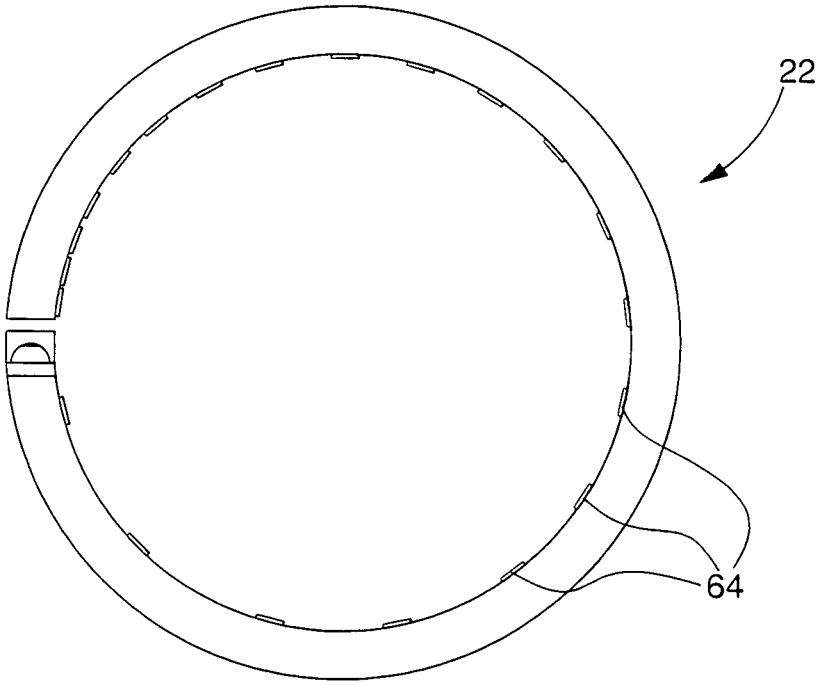

According to a second variant illustrated in FIG. 3C, light guide 22 is truncated at one location 56 on the perimeter thereof and light source 10 is inserted into the space left vacant between the opposite ends 22*a*, 22*b* of light guide 22. Preferably, for the optical coupling between light source 10 and light guide 22, the gap between light source 10 and end 22*a* of light guide 22, which acts as the entry surface thereof, is lined with an optical coupling element 57 formed of an optical gel such as silicon. Thus optimum efficiency is ensured for light injection into light guide 22.

The light rays which propagate inside light guide 22 at smaller angles than the maximum angle of reflection are totally reflected in light guide 22. To extract the light from light guide 22, light guide 22 is provided with a plurality of optical extractors 58. According to the circumstances (see FIGS. 3D to 3F), these optical extractors 58 may take the form of V-shaped grooves machined into the surface of light guide 22 or micro-lenses 62 distributed over the surface of light guide 22. Optical extractors 58 may also be formed by small printed surfaces 64 affixed to the surface of light guide 22. Optical extractors 58 may also be formed by pigment particles embedded in light guide 22. These particles act as so many centres of light diffusion and extraction. Advantageously, the optical extractors (grooves 60, micro-lenses 62, pigment particles or other) may be fabricated at the same time as light guide 22 by the injection of, for example, plastic material. It will be noted that, in order to optimise homogenisation of the density of light that escapes from light guide 22 over the entire perimeter thereof, the density of the optical extractors 58 (grooves 60, micro-lenses 62, pigment particles or other) may be varied, with the density increasing the further the extractors are from the point of injection of light into light guide 22.

Figure 4:
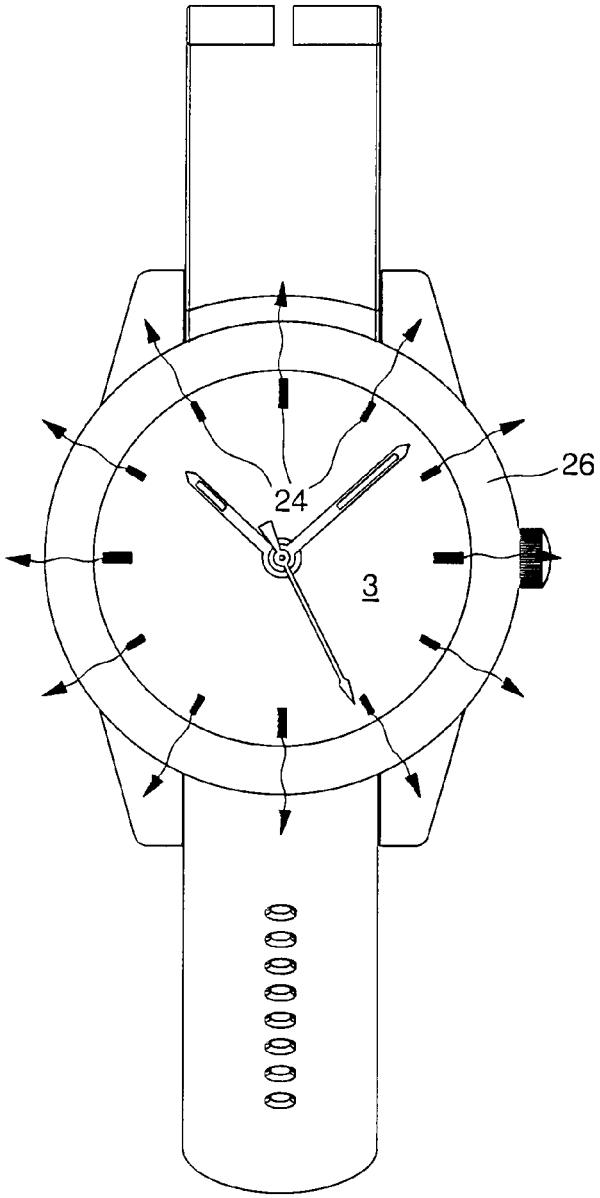
FIG. 4 is a top view of a wristwatch including a dial, in which the light passes through the dial appliques.

Until now, the present invention has been described with reference to the middle part as the only external element. However, it should be understood that the invention is in no way limited to this single embodiment and that it applies in the same manner to the other external watch elements, which are the back cover, the dial, bezel, flange, wristband strands and other elements. Thus, as shown in FIG. 4, for example appliques 24 can be illuminated on bezel 26 and dial 3. For this purpose, bezel 26 and dial 3 can be totally opaque and only allow light to escape where appliques 24 are located. It is also possible to envisage making bezel 26 and dial 3, for example, in a plastic, transparent or translucent material and then coating them with an opaque coloured mask which also only allows light to escape where appliques 24 are located. Conversely, dial 3 may be transparent or translucent and appliques 24 may be opaque. Back cover 2, middle part 1 and dial 3 could also be opaque and only a flange arranged between bezel 26 and dial 3 could be transparent or translucent, thus creating a luminous ring all around crystal 34.

FIG. 5A shows another original embodiment of the invention which is for injecting the light produced by light source 10 into the strands 30 of a transparent or translucent wristband. Thus, there is provided an opaque middle part 1, which has two transparent areas 32*a* and 32*b* substantially at midday and six o'clock, i.e. at the locations where the strands 30 of the wristband are fixed to said middle part 1. On the inner side of the watch case 6, two light sources 10 may be provided, each opposite one of the two transparent areas 32*a*, 32*b* of middle part 1. The light produced by the two light sources 10 emerges from watch case 6 through said two transparent areas 32*a*, 32*b* and is injected into the two transparent or translucent strands 30 of the wristband into which it is diffused, According to a variant, middle part 1 may be transparent or at the very least translucent. In this case, a material will preferably be selected for middle part 1 having a substantially lower refractive index than that of areas 32*a*, 32*b*, in order to ensure optimum efficiency of light injection into wristband strands 30.

By way of example (see FIG. 5B), light source 10 may be formed by a light emitting diode whose typical dimensions are on the order of 0.6 mm. The section of a wristband strand 30 at the location where this strand is connected to middle part 1 of the watch is on the order of 20 to 30 mm. To ensure illumination of the entire section of wristband 30, the two transparent areas 32*a* and 32*b* through which the light is diffused may be given a cone shape, wherein the aperture at the apex matches the width of wristband strand 30. The cone would also take advantage of the radiation pattern of most light emitting diodes available on the market.

According to a particular embodiment of the invention, the transparent parts 32*a* and 32*b* may be formed by two straight sections 68*a*, 68*b* of an optical fibre bar (see FIG. 5C). These sections are better known as fibre optical plates or FOPs. These plates return the light produced by the corresponding light source 10 to the respective exit surfaces thereof 66*a*, 66*b* opposite the two transparent wristband strands 30.

An example embodiment of a wristband strand 30 is illustrated in FIG. 7. According to this example, wristband strand 30 includes a light guide 48 which preferably extends over the entire length of said strand 30 and into which micro-prisms or micro-lenses are structured. For optimum efficiency of light injection into guide 48, the end of said guide 48 located on the side of middle part 1 of the watch is positioned at the same level as the transparent area 32*a* of middle part 1, opposite light source 10. Light guide 48 is overmoulded into a layer 50 of transparent plastic material such as silicon or polyurethane. This sandwich structure is completed by a decorative sheet 52 arranged above light guide 48, i.e. on the side of wristband strand 30 which is not in contact with the user's wrist. The light injected into guide 48 is deviated by the micro-prisms or micro-lenses and illuminates decorative sheet 52. This decorative sheet 52 is made in a material compatible with silicon or polyurethane such as PMMA. The decorative designs present in decorative sheet 52 may be obtained, for example, by an in-mould decoration technique (IMD).

FIG. 6 annexed to this Patent Application shows a cross-section along the 3 o'clock-6 o'clock axis of a watch case 6 with a digital display. As can be seen upon examining this Figure, watch case 6 includes, on the side of crystal 34, a liquid crystal digital display 36 including a front substrate 38 extending parallel to and at a distance from a back substrate 40. The front 38 and back 40 substrates are joined to each other by a sealing frame 42 which delimits a sealed volume for containing the liquid crystal. The liquid crystal cell 36 is a back lit cell, i.e. it includes a light guide 44, which is for example curved and arranged on the side of the back substrate 40 and follows the external contour of said display cell 36. The light produced by a light source 10, typically a light emitting diode (LED) is injected into light guide 44 and diffused therein so as to illuminate the display cell 36 and allow it to be read in the dark. In this case, the originality of the invention lies in the fact that the light which escapes through the sides 46 of the light guide 44 is used to illuminate, for example, the transparent or translucent parts of middle part 1 of the watch. Thus, according to the invention, the light injected into a light guide 44 is used not only for back lighting a liquid crystal display cell 36, but also for lighting all or part of the external elements (middle part 1, bezel 26) of a watch case 6.

It goes without saying that various simple alterations and variants can be envisaged by those skilled in the art without departing from the scope of the invention as defined by the annexed claims. Thus, as will have been clear from the foregoing, the invention concerns a timepiece which, in addition to a crystal, includes the following external elements: a back cover 2, middle part 1, dial 3, bezel 26 and two wristband strands 30, wherein at least one of these external elements is at least partially transparent or translucent, back cover 2, middle part 1 and bezel 26 define an internal volume 4 of watch case 6 which houses a timepiece movement M, and the timepiece is characterized in that it includes at least one light source 10, housed in the internal volume 4 and producing a light which passes through the transparent or translucent external element concerned.

When the external element concerned is made of a transparent or translucent material, it is dyed in the mass except at the location(s) where the light is required to escape from the internal volume 4 of watch case 6. According to a variant, the external element concerned made of transparent or translucent plastic material may be coated internally or externally with a layer of light absorbent material except at the location(s) where the light is required to escape from the internal volume 4 of watch case 6.

If light source 10 emits ultraviolet, violet, blue, white or infra-red light, the external element is charged with fluorescent and/or phosphorescent particles at the location(s) where the light is required to escape from the internal volume 4 of watch case 6.

As will also have been clear from the foregoing, it is an object of the present invention to cause light to escape from the internal volume 4 of watch case 6 to the exterior. Another aspect of the invention consists in lighting from the inside 4 of watch case 6 elements that are external thereto. Thus, middle part 1 may be transparent or at the very least translucent in the parts 32*a*, 32*b* thereof opposite the areas where the wristband strands 30 are connected, such that the light which passes through transparent parts 32*a*, 32*b* of middle part 1 are diffused in the wristband strands 30, which are also transparent or translucent.

According to another embodiment of the invention, the external element is made of a metallic material. In such case, a through passage is provided in which a transparent or translucent element is engaged at the place or places where the light is required to escape from the internal volume 4 of the watch case 6. By way of example, when the timepiece includes a winding crown or a push-button 16, there is engaged in through passage 18 a transparent or translucent cylinder 20, which may act both as a mechanical guide for the winding crown or a push-button 16 and as light guide for the light which escapes from the internal volume 4 of watch case 6, the external diameter of transparent or translucent cylinder 20 being greater than the external diameter of the crown or push-button 16. It will be noted that at least the lighting of light source 10 can be controlled by the user, for example by pressure on a push-button such as push-button 16 or by pressing a finger on a tactile key. The light source can also be switched off by an additional application of pressure to push-button 16 or it may be switched off by control circuit 12 after a predetermined time interval. Light source 10 may also be switched on and off by an automatic system such as a photosensitive sensor according to the degree of ambient luminosity. The photosensitive sensor will then switch on the light source when the degree of ambient luminosity falls below a predetermined threshold and will switch off the light source when the degree of ambient luminosity exceeds a predetermined threshold. According to yet another variant, the light source may be switched on and off by the application of a shock to the watch case or an abrupt wrist movement, the shock or acceleration being detected by an accelerometer housed in the watch.

According to yet another variant, the light produced by light source 10 is injected into a diffusing optical fibre 22 which diffuses the light over the entire length thereof.

It is also possible to envisage the light exiting through dial 3. In this case, dial 3 is opaque except at the location of appliques 24, which are transparent or at the very least translucent and through which the light can escape from internal volume 4 of watch case 6. Dial 3 may be made in an opaque material or be transparent or be coated in such case by a layer of opaque material except at the location of appliques 24.

The invention claimed is:

1. A timepiece comprising:

a crystal;

external elements including: a back cover, a middle part, a dial, a bezel, and two wristband strands, wherein at least one of the external elements is at least partially transparent or translucent, and the back cover, the middle part, and the bezel define an internal volume of the watch case that houses a watch movement;

at least one light source housed in the internal volume of the watch case and producing a light that passes through the transparent or translucent part of the at least one external element;

on a side of a crystal, a digital display underneath which there is arranged a light guide into which the light produced by the light source is injected for back lighting the digital display, wherein light that escapes through sides of the light guide that are opposite the middle part and the back cover of the watch case pass through the transparent or translucent part of the at least one external element.

2. The timepiece according to claim 1, wherein the at least one external element is made of a transparent or translucent material selected from the group of plastic materials, ceramic materials, sapphire, or silica glass.

3. The timepiece according to claim 2, wherein the external element concerned is dyed in mass except at locations where the light is required to escape from the internal volume of the watch case.

4. The timepiece according to claim 2, wherein the at least one external element is internally or externally coated with a layer of light absorbent material except at the locations where the light is required to escape from the internal volume of the watch case.

5. The timepiece according to claim 1, wherein the light source emits ultraviolet, violet, blue, white, or infra-red light, and wherein the external element is charged with fluorescent and/or phosphorescent particles at locations where the light is required to escape from the internal volume of the watch case.

6. The timepiece according to claim 1, wherein the middle part is transparent or translucent, at least in parts thereof opposite areas where the wristband strands are connected, so that light that passes through the transparent parts of the middle part is diffused into the wristband strands that are also transparent or translucent.

7. The timepiece according to claim 6, wherein the wristband strand includes a light guide inside that are structured micro-prisms or micro-lenses, the light guide being overmolded in a layer of transparent plastic material to create a sandwich structure completed by a decorative sheet, arranged above the light guide, on a side of the wristband that is not in contact with a user's wrist.

8. The timepiece according to claim 7, wherein the layer in which the light guide is overmolded is made of silicon or polyurethane, and wherein the decorative sheet is made of PMMA, decorative patterns present in the decorative sheet being obtained by an in-mold decoration technique.

9. The timepiece according to claim 1, wherein, when the external element is made of a metallic material, there is provided a through passage in which a transparent or translucent element is engaged at locations where the light is required to escape from the internal volume of the watch case.

10. The timepiece according to claim 9, further comprising a winding crown or a push-button, wherein the winding crown or push-button is surrounded by a transparent or translucent cylinder, which acts as a light guide for the light that escapes from the internal volume of the watch case, the external diameter of the transparent or translucent cylinder being greater than the diameter of the crown or push-button.

11. The timepiece according to claim 10, wherein the cylinder also acts as a mechanical guide for the winding crown or the push-button.

12. The timepiece according to claim 1, wherein at least switching on of the light source is controlled by a user.

13. The timepiece according to claim 1, wherein at least switching on of the light source is controlled by an automatic system.

14. The timepiece according to claim 1, wherein the light produced by the light source is injected into a light guide, which then brings the light to the transparent or translucent areas of the at least one external element.

15. The timepiece according to claim 14, wherein the light guide is an optical fiber that can move around obstacles that may stand between the light source and the transparent or translucent area of the external element concerned through which the light will escape from the internal volume of the watch case.

16. The timepiece according to claim 15, wherein the optical fiber is an optical fiber that diffuses the injected light over an entire length thereof.

17. The timepiece according to claim 1, wherein the dial is opaque except at location of appliques, which are transparent or translucent and through which the light can escape from the internal volume of the watch case.

18. The timepiece according to claim 17, wherein the dial is made of an opaque material.

19. The timepiece according to claim 17, wherein the dial is transparent and is coated with a layer of opaque material except at a location of the appliques.

20. The timepiece according to claim 17, wherein the dial is transparent and wherein the appliques are opaque.

* * * * *